US009422890B2

(12) United States Patent
Yamazaki et al.

(10) Patent No.: US 9,422,890 B2
(45) Date of Patent: Aug. 23, 2016

(54) ROTARY CARBURETOR

(71) Applicants: YAMABIKO CORPORATION, Tokyo (JP); ZAMA JAPAN Co., Ltd., Iwate (JP)

(72) Inventors: Takahiro Yamazaki, Tokyo (JP); Hisato Onodera, Tokyo (JP); Takumi Nonaka, Iwate (JP); Kazuyuki Tateyanagi, Iwate (JP)

(73) Assignees: YAMABIKO CORPORATION, Ohme-Shi, Tokyo (JP); ZAMA JAPAN CO., LTD., Hachimantai-Shi, Iwate (JP)

( * ) Notice: Subject to any disclaimer, the term of this patent is extended or adjusted under 35 U.S.C. 154(b) by 175 days.

(21) Appl. No.: 14/511,385

(22) Filed: Oct. 10, 2014

(65) Prior Publication Data

US 2015/0102511 A1 Apr. 16, 2015

(30) Foreign Application Priority Data

Oct. 10, 2013 (JP) ..... 2013-212981

(51) Int. Cl.

| | |
|---|---|
| ***F02M 9/08*** | (2006.01) |
| ***F02B 17/00*** | (2006.01) |
| ***F02B 25/22*** | (2006.01) |
| ***F02M 9/06*** | (2006.01) |
| ***F02M 9/12*** | (2006.01) |
| ***F02M 17/10*** | (2006.01) |
| ***F02M 19/00*** | (2006.01) |
| *F02B 75/02* | (2006.01) |

(52) U.S. Cl.

CPC ..... *F02M 9/08* (2013.01); *F02B 17/00* (2013.01); *F02B 25/22* (2013.01); *F02B 75/02* (2013.01); *F02M 9/06* (2013.01); *F02M 9/085* (2013.01); *F02M 9/12* (2013.01); *F02M 17/10* (2013.01); *F02M 19/00* (2013.01); *F02B 2075/025* (2013.01)

(58) Field of Classification Search

CPC ..... F02M 9/08; F02M 17/00
USPC ..... 123/319; 261/38, 64.1, 66
See application file for complete search history.

(56) References Cited

U.S. PATENT DOCUMENTS

| | | | | |
|---|---|---|---|---|
| 7,261,281 | B2 | 8/2007 | Raffenberg | |
| 7,325,791 | B2 | 2/2008 | Koizumi | |
| 2006/0131763 | A1 | 6/2006 | Raffenberg | |
| 2007/0057386 | A1 | 3/2007 | Koizumi | |
| 2008/0041466 | A1 | 2/2008 | Aihara et al. | |
| 2009/0072417 | A1 | 3/2009 | Koizumi | |
| 2009/0194726 | A1 | 8/2009 | Aihara et al. | |
| 2009/0283079 | A1 | 11/2009 | Tsunoda | |
| 2012/0240907 | A1 | 9/2012 | Watanabe et al. | |
| 2013/0228152 | A1 * | 9/2013 | Ono | F02M 9/08 123/319 |

FOREIGN PATENT DOCUMENTS

| | | | |
|---|---|---|---|
| EP | 2492486 | A1 | 8/2012 |
| JP | 2006-177352 | A | 7/2006 |

* cited by examiner

*Primary Examiner* — Robert A Hopkins
(74) *Attorney, Agent, or Firm* — Baker & Hostetler LLP

(57) ABSTRACT

In a carburetor, three downstream body passages in the body communicate with three valve passages in the valve element, and the valve element rotates between a closed position and an opened position. The carburetor is a one-bore type carburetor in which the body passages and the valve passages are respectively partitioned with the body partitions and the valve partitions. When rotating the valve element from the closed position to the opened position, the second body passage and the second valve passage for mixture start to communicate in advance than the first and third body passages and the first and third valve passages for air.

8 Claims, 6 Drawing Sheets

ROTARY CARBURETOR

CROSS-REFERENCE TO RELATED APPLICATION

This application claims priority to foreign Japan patent application No. JP 2013-212981, filed on Oct. 10, 2013, the disclosure of which is incorporated by reference in its entirety.

TECHNICAL FIELD

The present invention relates to a rotary carburetor which is used in a two-stroke internal combustion engine, and more specifically, to a rotary carburetor has air supply channel which is used in a stratified scavenging two-stroke internal combustion engine.

BACKGROUND ART

A stratified scavenging two-stroke internal combustion engine includes a mixture passage for supplying air-fuel mixture to a crank case, and an air passage for supplying scavenging air to a scavenging passage. A carburetor is provided in the mixture passage, a throttle valve is provided in the carburetor. In the air passage, an air valve is provided. Conventionally, a rotary carburetor is known in which the throttle valve and the air valve are integrated with the carburetor, as shown in the Patent Documents 1 and 2, for example. Each of the rotary carburetors described in the Patent Documents 1 and 2 includes a body, and a valve element which is rotatably contained in the body, and is configured so that when the valve element is rotated, a mixture passage and an air passage provided in the body, and a mixture passage and an air passage provided in the valve element are communicated or blocked off, namely, the throttle valve and the air valve are opened or closed.

In the Patent Document 1, a two-bore type rotary carburetor is described, in which two bores consisting of a mixture bore with a circular cross section and an air bore with a circular cross section are provided. In the Patent Document 2, a one-bore type rotary carburetor is described in which two passages consisting of a mixture passage with a semi-circular cross section and an air passage with a semi-circular cross section are provided, and the two passages are appeared to form one bore by partitioning them with a plate-like partition.

PRIOR ART PUBLICATION

Patent Document 1: U.S. Pat. No. 7,325,791

Patent Document 2: Japanese Patent Laid-open Publication No. 2006-177352

SUMMARY OF THE INVENTION

Problem to be Solved by the Invention

The body of the two-bore type rotary carburetor is large. Further, since the length of the two-bore type rotary carburetor is about two times of that of the one-bore type rotary carburetor, friction between the rotary valve and the body passage is increased. Thus, an excessive force is required for the throttle work.

In order to obtain a good acceleration, there are a first request for increasing a ratio of the amount of mixture relative to the amount of air in a low speed region of the engine, that is, in a region where the opening of the throttle valve is relatively small, and a second request for sufficiently supplying scavenging air to the scavenging passage in a high speed region of the engine, that is, in a state where the throttle is fully opened.

In order to achieve the first request in the two-bore type rotary carburetor, the valve element may be configured so that when the valve element starts to rotate from a state where the mixture bore and the air bore are blocked off, the mixture bore starts to communicate earlier than the air bore, rather than the mixture bore and the air bore do not start to communicate almost simultaneously. Specifically, a diameter of the mixture bore may be larger than a diameter of the air bore, or a profile of the mixture bore and a profile of the air bore may be deformed. In the former case, since the diameter of the mixture bore is large while the amount of air is maintained, the body tends to become large than that in a case where the diameter of the mixture bore is the same as the diameter of the air bore. In the latter case, manufacture of the body is complicated, and the body tends to become large.

The one-bore type rotary carburetor, as shown in FIG. 7 explained later, is more compact than the two-bore type rotary carburetor, but it has a tendency that the ratio of the amount of mixture and the amount of air is constant from the low speed region to the high speed region, as shown in FIG. 8 explained later. In order to achieve the above-stated first request, that is, in order to arrange so that the mixture bore starts to communicate earlier than the air bore when the valve element is rotated from the state where the mixture bore the air bore are blocked off, for example, the inlet and outlet of the air bore passage in the body may be closed by a wall of the body, or the air bore may be partially expanded. However, in the former case, when the air bore is fully opened in the high speed region, that is, in the full throttle state, the flow of air is blocked by the above-stated wall of the body and detours, and the efficiency of supplying air decreases, and thus, the above-stated second request cannot be achieved. In the latter case, the flow of air is disturbed by the expanded part, and the efficiency of supplying air decreases, and thus, the above-stated second request cannot be achieved. The expanded part may cause fuel stagnation depending on a posture of the rotary carburetor, for example, when the worker changes the posture of the working machine. On the contrary, if the carburetor is configured to achieve the above-stated second request, the above-stated first request cannot be achieved.

Therefore, using the conventional one-bore type rotary carburetor, it is difficult to make the above-stated first request and the above-stated second request compatible, where the above-stated first request is a good acceleration performance by increasing the ratio of the mixture relative to the air in the low speed region where the opening of the throttle valve is relatively small, and the above-stated second request is supplying sufficient amount of air to the scavenging passage by increasing the ratio of the air relative to the mixture in the high speed region where the opening of the throttle valve is relatively large.

Accordingly, it is an object of the present invention to provide a one-bore type rotary carburetor which is capable of enhancing an acceleration performance by increasing the ratio of the amount of mixture relative to the amount of air in the low speed region, and which is also capable of sufficiently supplying the scavenging air to the scavenging passage by increasing the ratio of the amount of air relative to the amount of mixture in the high speed region.

Means for Solving the Problem

In order to achieve the above-stated object, a rotary carburetor according to the present invention is a rotary carburetor which is used in a stratified scavenging two-stroke internal combustion engine, comprising: a block-like body having a cylindrical bore with a center of an axis; a valve element having a cylindrical form and rotatably contained in the bore; and a nozzle unit disposed in the valve element along the axis, wherein the valve element includes valve passages for air and valve passage for mixture extending through the valve element in a direction across the axis, wherein the carburetion unit includes a port which is opened to the valve passage for mixture and ejects fuel, wherein the body includes upstream body passage communicating with the valve passages for air and the valve passage for mixture upstream of the valve element, and downstream body passages for air and downstream body passage for mixture respectively communicating with the valve passages for air and the valve passage for mixture downstream of the valve element, wherein the valve element is rotatable around the axis between an opened position and a closed position, wherein in the opened position, the valve passages for air and the valve passage for mixture respectively communicate with the downstream body passages for air and the downstream body passage for mixture, and the valve passages for air and the valve passage for mixture respectively communicate with the upstream body passage, wherein in the closed position, the valve passages for air and the valve passage for mixture are respectively blocked off from the downstream body passages for air and the downstream body passage for mixture, and the valve passages for air and the valve passage for mixture are blocked off from the upstream body passage, wherein the rotary carburetor is a one-bore type rotary carburetor in which the valve passages for air and the valve passage for mixture are partitioned with plate-like valve partitions, and the downstream body passages for air and the downstream body passage for mixture are partitioned with plate-like body partitions, wherein the two downstream body passages for air and the two valve passages for air are provided, and are respectively disposed on the opposite sides of the downstream body passage for mixture and the valve passage for mixture in the axis direction, wherein cross-sectional profiles of the downstream body passage for mixture and the valve passage for mixture are defined so that they are communicated earlier than the downstream body passages for air and the valve passages for air, when the valve element is rotated from the closed position to the opened position, and wherein the cross-sectional profiles of the two downstream body passages for air and the two valve passages for air correspond to each other.

Since this rotary carburetor is a one-bore type rotary carburetor in which the valve passages for air and the valve passage for mixture are partitioned with plate-like valve partitions, and the downstream body passages for air and the downstream body passage for mixture are partitioned with plate-like body partitions, it can be made smaller than the two-bore type rotary carburetor. In addition, the two downstream body passages for air and the two valve passages for air are provided and respectively disposed on the opposite sides of the downstream body passage for mixture and the valve passage for mixture in the axis direction, and the cross-sectional profiles of the downstream body passage for mixture and the valve passage for mixture are defined so that they are communicated with each other earlier than the downstream body passages for air and the valve passages for air when the valve element is rotated from the closed position to the opened position. Thus, the ratio of the amount of mixture relative to the amount of air becomes large in the low speed region, and the acceleration performance can be enhanced. In addition, since the two downstream body passages for air and the two valve passages for air are provided and disposed on the opposite sides of the downstream body passage for mixture and the valve passage for mixture in the axis direction, and the cross-sectional profiles of the two downstream body passages for air and the two valve passages for air correspond to each other, the ratio of the amount of air relative to the amount of mixture can be easily made large in the high speed region, and an uninterrupted air flow is ensured so that the scavenging air is sufficiently supplied to the scavenging passage. As a result, the first request in the low speed and the second request in the high speed are compatible.

In an embodiment of the rotary carburetor according to the present invention, preferably, a collective cross-sectional profile of the valve passages for air and the valve passage for mixture has a profile curved in a convex form in a direction across the axis, and an apex in the convex form is included in the valve passage for mixture. More preferably, a collective cross-sectional profile of the valve passages for air and the valve passage for mixture is circular or elliptical.

In an embodiment of the rotary carburetor according to the present invention, preferably, the valve element is movable in the bore along the axis, and the second valve passage and the first downstream body passage, or, the second valve passage and the third downstream body passage are partially communicated with each other during at least a portion when the valve element moves from the closed position to a fully opened position.

In this rotary carburetor, in a state where the two-stroke internal combustion engine (not shown) is subject to a partial load, the mixture is supplied to the scavenging passage (not shown) into the two-stroke internal combustion engine (not shown) through the downstream body passage for air. Utilizing this matter, it is possible to control the fuel supply characteristics to the two-stroke internal combustion engine (not shown), so that the acceleration characteristics can be enhanced and/or the supply characteristics of the fuel is prevented from being lean in the partial load state.

In an embodiment of the rotary carburetor according to the present invention, preferably, the upstream body passage includes upstream body passages for air and upstream body passage for mixture respectively communicating with the valve passages for air and the valve passage for mixture, and the upstream body passages for air and the upstream body passage for mixture are partitioned with plate-like body partitions. The upstream body passages may be a single passage which is not provided with any partitions.

In another aspect, a rotary carburetor which is used in a stratified scavenging two-stroke internal combustion engine in which at least one scavenging passage is provided on each side of a mixture inlet, comprising: a block-like body having a cylindrical bore with a center of an axis; a valve element having a cylindrical form and rotatably contained in the bore; and a nozzle unit disposed in the valve element along the axis, wherein the valve element includes valve passages for air and valve passage for mixture extending through the valve element in a direction across the axis, wherein the nozzle unit includes a port which is opened to the valve passage for mixture and ejects fuel, wherein the body includes upstream body passage communicating with the valve passages for air and the valve passage for mixture upstream of the valve element, and downstream body passages for air and downstream body passage for mixture respectively communicating with the valve passages for air and the valve passage for mixture downstream of the valve element, wherein the valve element is rotatable around the axis between an opened position and a closed position, wherein in the opened position, the valve passages for air and the valve passage for mixture respectively communicate with the downstream body passages for air and the downstream body passage for mixture, and the valve passages for air and the valve passage for mixture communicate with the upstream body passage, wherein in the closed position, the valve passages for air and the valve passage for mixture are respectively blocked off from the downstream body passages for air and the downstream body passage for mixture, and the valve passages for air and the valve passage for mixture are blocked off from the upstream body passage, wherein the rotary carburetor is a one-bore type rotary carburetor in which the valve passages for air and the valve passage for mixture are partitioned with plate-like valve partitions, and the downstream body passages for air and the downstream body passage for mixture are partitioned with plate-like body partitions, and wherein the two downstream body passages for air and the two valve passages for air are provided and respectively disposed on each side of the downstream body passage for mixture and the valve passage for mixture in the axis direction.

In this rotary carburetor, since the downstream body passages for air are provided on each side of the downstream body passage for mixture, a piping arrangement with the two-stroke internal combustion engine becomes easy when the rotary carburetor is used with the stratified scavenging two-stroke internal combustion engine in which at least one scavenging passage is provided on each side of the mixture inlet. Since the main purpose is to facilitate the piping arrangement, it is not necessarily to satisfy the first request and the second request.

Effect of the Invention

As explained above, the one-bore type rotary carburetor according to the present invention allows the body in the small size, improves the acceleration performance by increasing the ratio of the amount of mixture relative to the amount of air in the low speed region, and sufficiently supplies the scavenging air to the scavenging passage by increasing the ratio of the amount of air relative to the amount of mixture in the high speed region.

DESCRIPTION OF EMBODIMENTS

An embodiment of a rotary carburetor according to the present invention will be explained with reference to the drawings. The rotary carburetor is used in a stratified scavenging two-stroke internal combustion engine (not shown).

Figure 1:
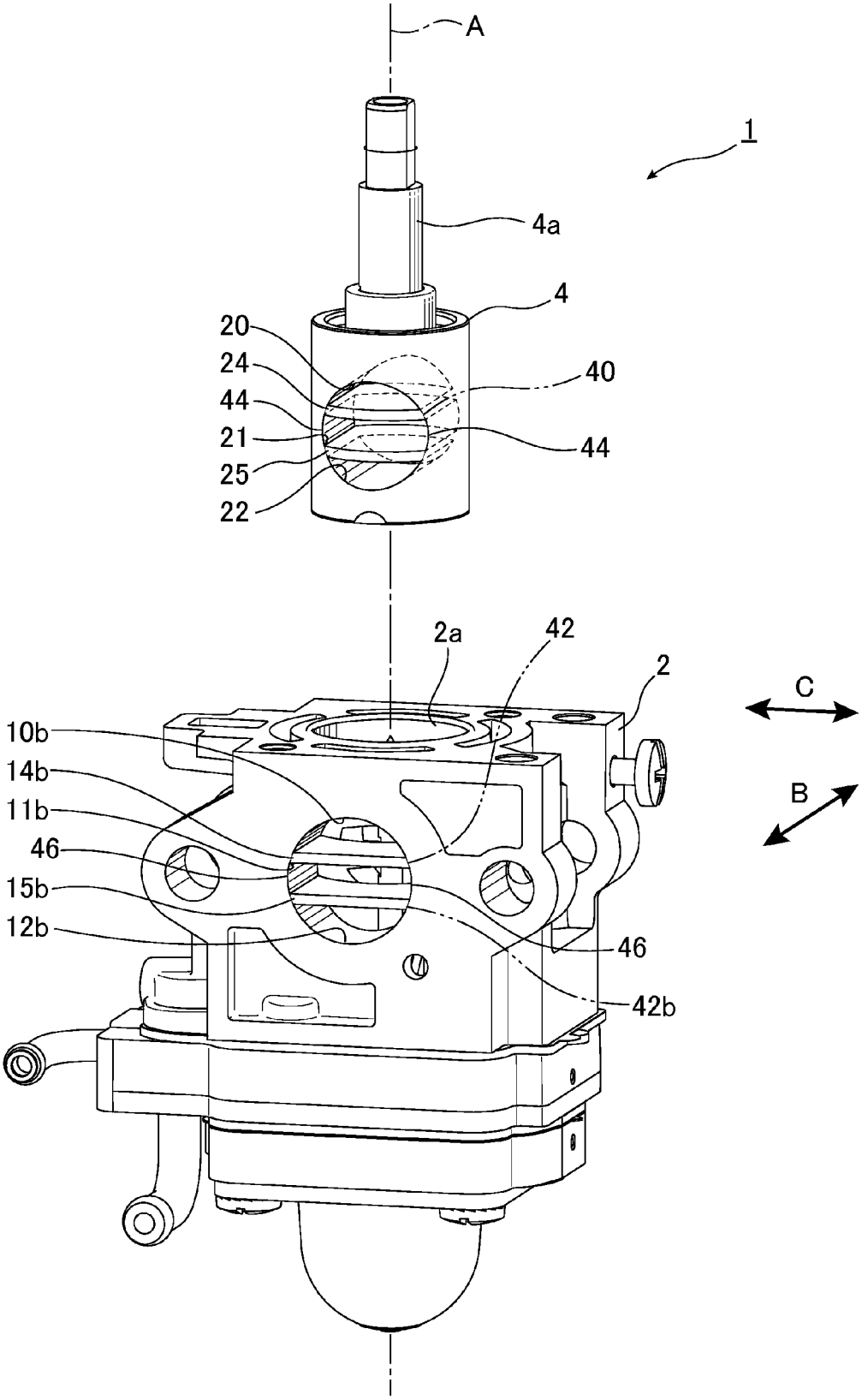
FIG. 1 is an exploded perspective view of the rotary carburetor according to the present invention.

As shown in FIG. 1, a rotary carburetor 1 includes a block-like body 2 having a cylindrical bore 2*a* with a center of an axis A, and a valve element 4 having a cylindrical form and being rotatably contained in the bore 2*a*. In FIG. 1, a lid 2*b* (see FIG. 2) of the body 2 is omitted.

Figure 2:
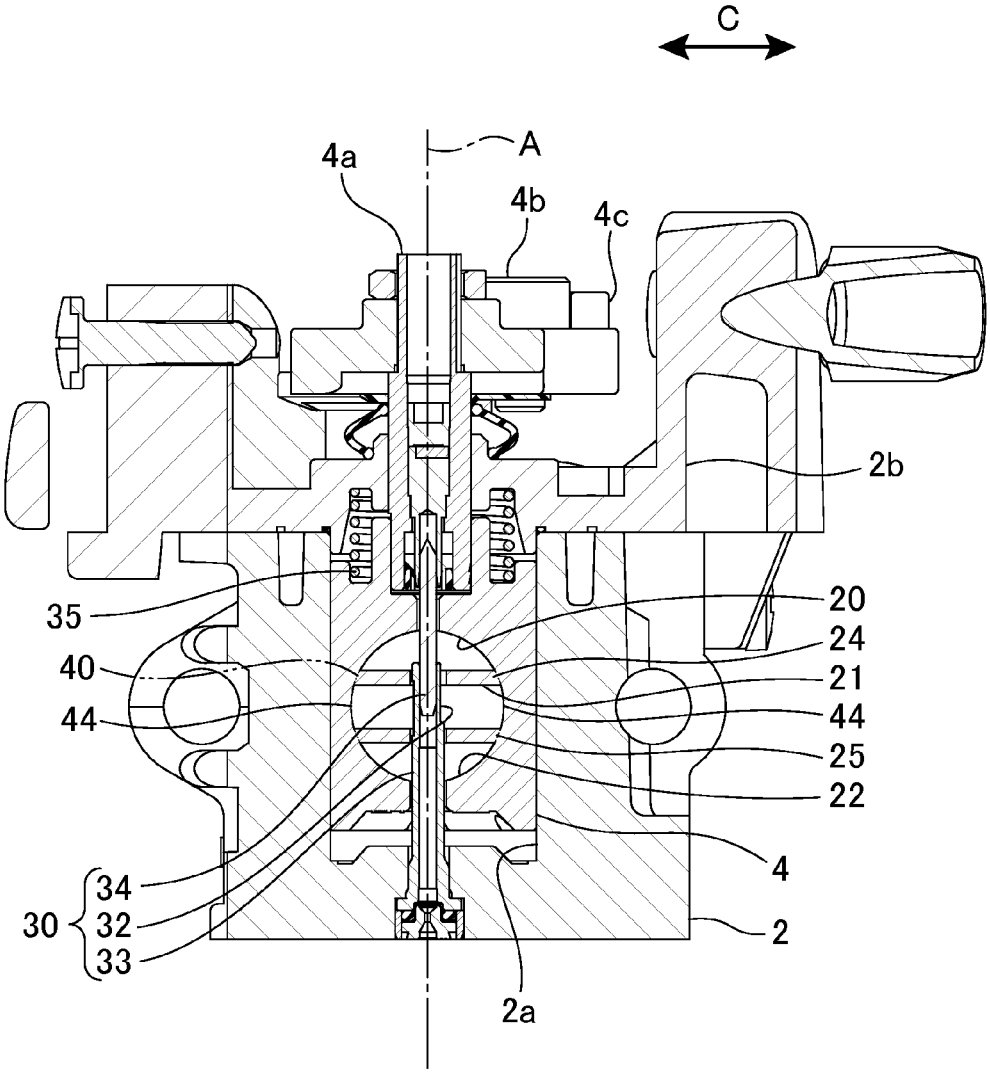
FIG. 2 is a cross-sectional front view of the rotary carburetor according to the present invention.
Figure 3:
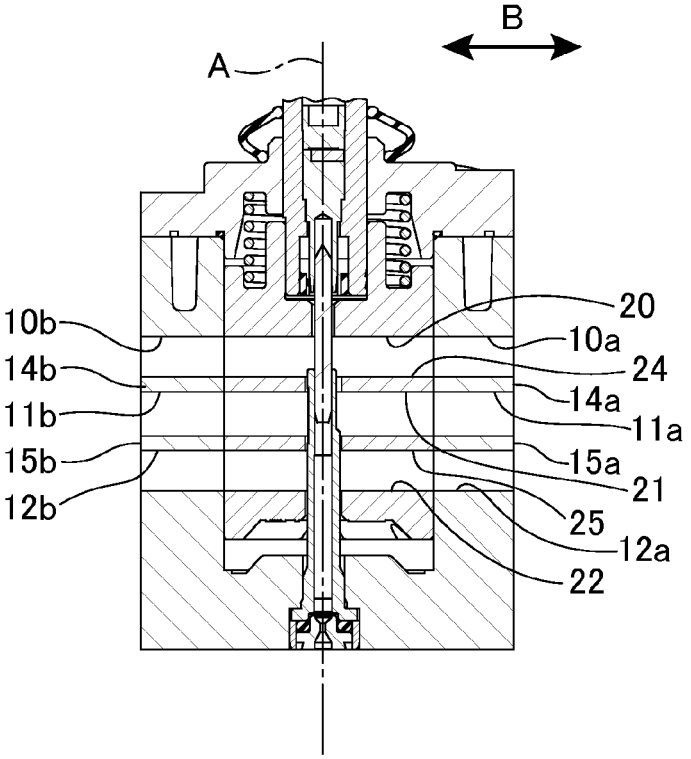
FIG. 3 is a cross-sectional side view of the rotary carburetor according to the present invention in an opened position.

As shown in FIGS. 1-3, the valve element 4 includes first, second and third valve passages 20, 21, 22 extending through the valve element 4 in a direction B across the axis A. The first, second and third valve passages 20, 21, 22 are arranged side by side in a direction of the axis A, and are partitioned with two plate-like valve partitions 24, 25. The valve element 4 is formed of, for example, aluminum. The partitions 24, 25 may be formed integrally with other parts of the valve element 4, or assembled with, for example, inserted into, other parts of the valve element 4 after the partitions are separately formed from the parts.

The body 2 includes first, second and third upstream body passages 10*a*, 11*a*, 12*a* respectively communicating with the first, second and third valve passages 20, 21, 22 upstream of the valve element 4, and first, second and third downstream body passages 10*b*, 11*b*, 12*b* respectively communicating with the first, second and third valve passages 20, 21, 22 downstream of the valve element 4. Both of the first, second and third upstream body passages 10*a*, 11*a*, 12*a* and the first, second and third downstream body passages 10*b*, 11*b*, 12*b* are arranged side by side in the direction of the axis A, and are respectively partitioned with two plate-like upstream body partitions 14*a*, 15*a* and two plate-like downstream body partitions 14*b*, 15*b*. The body 2 is formed of, for example, aluminum. The upstream body partitions 14*a*, 15*a* and the downstream body partitions 14*b*, 15*b* may be formed integrally with other parts of the body 2, or assembled with, for example, inserted into, other parts of the body 2 after the body partitions are separately formed from the parts.

Figure 4:
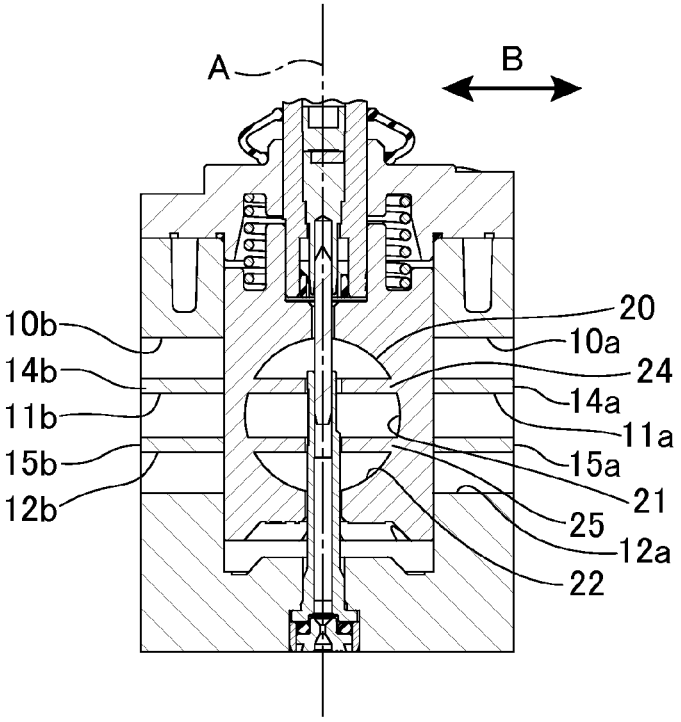
FIG. 4 is a cross-sectional side view of the rotary carburetor according to the present invention in a closed position.

As shown in FIGS. 3 and 4, the valve element 4 is rotatable around the axis A between a closed position where the first, second and third upstream body passages 10*a*, 11*a*, 12*a*, the first, second and third downstream body passages 10*b*, 11*b*, 12*b* and the first, second and third valve passages 20, 21, 22 are respectively blocked off (see FIG. 4), and an opened position where the first, second and third upstream body passages 10*a*, 11*a*, 12*a*, the first, second and third downstream body passages 10*b*, 11*b*, 12*b* and the first, second and third valve passages 20, 21, 22 respectively communicate with each other (see the full opened position shown in FIG. 3, for example). Specifically, as shown in FIGS. 1 and 2, a valve driving shaft 4*a* extends from the valve element 4 along the axis A, and the valve element 4 is rotated by using an actuator (not shown) to actuate a lever 4*b* attached to the valve driving shaft 4*a*.

The first and third downstream body passages 10*b*, 12*b* are connected to an air passage (not shown) communicating with a scavenging passage (not shown) of a two-stroke internal combustion engine (not shown), while the second downstream body passage 11*b* between the first downstream body passage 10*a* and the third downstream body passage 12*b* is connected to a mixture passage (not shown) of the two-stroke internal combustion engine (not shown).

As shown in FIG. 2, the rotary carburetor 1 further includes a carburetion unit 30 disposed in the valve element 4 along the axis A for ejecting a fuel into the second valve passage 21. The carburetion unit 30 is prior art as described in the Patent Document 1.

Briefly, the carburetion unit 30 includes a port 32 which is opened to the second valve passage 21 and configured to eject the fuel, and the port 32 is formed near a tip of a cylindrical needle receiving part 33 fixed to the body 2. The carburetion unit 30 further includes a needle 34 which is fixed to the nozzle element and which is insertable into the needle receiving unit 33, and an amount of ejection of the fuel is adjusted by varying an amount of insertion of the needle 34 into the needle receiving part 33.

In order to change the amount of insertion of the needle 34, the needle element 4 is movable in the bore 2*a* along the axis A, and is biased by a spring 35 in the direction of inserting the needle 34 (a direction of closing the port 32). A cam 4*c* abuts a lever 4*b*, the cam 4*c* urging the needle 34 in a direction of pulling the needle 34 from the needle receiving unit 33 against the spring 35 depending on the rotational position of the nozzle element 4 (that is, depending on the communicated area between the second downstream body passage 11*b* and the second valve passage 21 corresponding to an opening of the throttle valve). FIGS. 2-4 show a state where the needle 34 is pulled out most from the needle receiving unit 33 (the full opened state).

As shown in FIGS. 1 and 2, both of a collective cross-sectional profile 40 of the first, second and third valve passages 20, 21, 22, and a collective cross-sectional profile 42*b* of the first, second and third body downstream passages 10*b*, 11*b*, and 12*b* appear to form one bore. The cross-sectional profiles of the first, second and third downstream body passages 10*b*, 11*b*, 12*b* respectively correspond to the cross-sectional profiles of the first, second and third valve passages 20, 21, 22. Although not shown, a collective cross-sectional profile of the first, second and third upstream body passages 10*a*, 11*a*, 12*a* also appears to form one bore. The cross-sectional profiles of the first, second and third upstream body passages 10*a*, 11*a*, 12*a* respectively correspond to the cross-sectional profiles of the first, second and third valve passages 20, 21, 22.

The cross-sectional profiles of the second downstream body passage 11*b* and the second valve passage 21 are defined so as to start communication earlier than the first and third downstream body passages 10*b*, 12*b* and the first and third valve passages 20, 22 when the valve element 4 is rotated from the closed position to the opened position. In the present embodiment, the collective cross-sectional profile 40 of the first, second and third valve passages 20, 21, 22 is curved in a convex form in a direction C across the axis A and perpendicular to the direction B, and an apex 44 of the convex form is included in the second valve passage 21. Similarly, the collective cross-sectional profile 42*b* of the first, second and third downstream body passages 10*b*, 11*b*, 12*b* is curved in a convex form in the direction C across the axis A and perpendicular to the direction B, and an apex 46 of the convex form is included in the second downstream passage 11*b*. Specifically, the cross-sectional profiles 40, 42*b* are circulars.

Next, referring to FIGS. 5 and 6, an operation of the rotary carburetor according to the present invention will be explained.

Figure 5:
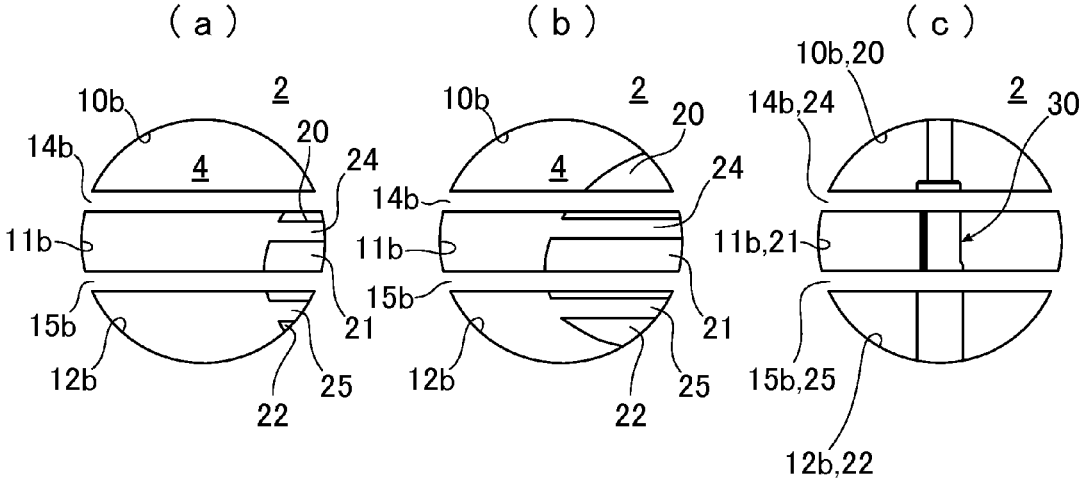
FIG. 5 is a view showing a positional relationship between a downstream body passage and a valve passage of the rotary carburetor according to the present invention.

When the valve element 4 starts to rotate from the closed position (see FIG. 4), initially, as shown in FIG. 5(*a*), the second valve passage 21 communicates with the second downstream body passage 11*b*, and then, as shown in FIG. 5(*b*), the first and third valve passages 20, 22 communicate with the first and third downstream body passages 10*b*, 12*b*. Since the first, second and third valve passages 20, 21, 22 are provided in the valve element 4 in the cylindrical form, when a range of the cross-sectional profile of the second valve passage 21 in the direction C covers ranges of the cross-sectional profiles of the first and third valve passages 20, 22 in the direction C, the second valve passage 21 communicates earlier than the first and third valve passages 20, 22.

A state shown in FIG. 5(*a*) is a state of the low speed region where the rotational angle of the valve element 4 from the closed position (see FIG. 4) is small (namely, an opening of the throttle valve is small), and the communicated area between second downstream body passage 11*b* and the second valve passage 21 becomes larger than the sum of the communicated area between the first downstream body passage 10*b* and the first valve passage 20 and the communicated area between the third downstream body passage 12*b* and the third valve passage 22. As the result, the ratio of the mixture relative to the air becomes large, thereby enabling to improve the acceleration performance of the two-stroke internal combustion engine (see FIG. 6). In FIG. 5(*a*), the valve element 4 is biased by the spring 35, and thus, the downstream body partitions 14*b*, 15*b* of the body 2 and the partitions 24, 25 of the valve element 4 are not aligned with each other completely.

A state shown in FIG. 5(*b*) is a state where the rotational angle of the valve element 4 from the closed position (see FIG. 4) is increased more than that shown in FIG. 5(*a*) (the state where the opening of the throttle valve is increased more than that shown in FIG. 5(*a*)), and the communicated area between the second downstream body passage 11*b* and the second valve passage 21 becomes almost equal to the sum of the communicated area between the first downstream body passage 10*b* and the first valve passage 20 and the communicated area between the third downstream body passage 12*b* and the third valve passage 22. In FIG. 5(*b*), the valve element 4 is biased by the spring 35, the downstream body partitions 14*b*, 15*b* of the body 2 and the partitions 24, 25 of the valve element 4 are not aligned with each other completely.

In FIGS. 5(*a*) and 5(*b*), the second valve passage 21 and the third downstream body passage 12*b* are partially communicated with each other. Consequently, in the state where the two-stroke internal combustion engine (not shown) is partially loaded, the mixture is supplied to the scavenging passage (not shown) of the two-stroke internal combustion engine (not shown) through the third downstream body passage 12*b*. Utilizing this matter, by changing the form of the cam 4C, it makes possible to control the fuel supply characteristics to the two-stroke internal combustion engine (not shown), and thus it enables to improve the acceleration characteristics and/or to prevent the fuel supply characteristics from being lean in a partially loaded state. In this case, a time period during which the second valve passage 21 and the third downstream body passage 12*b* are partially communicated with each other is optionally defined depending on a purpose.

Figure 6:
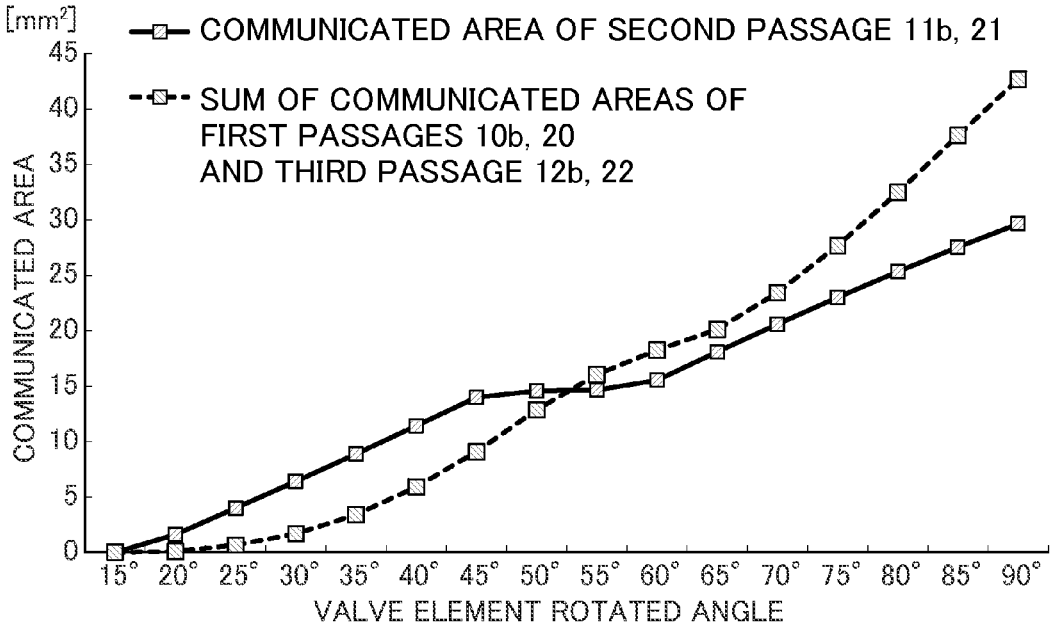
FIG. 6 is a graph showing opening areas of the mixture passage and the air passage in the rotary carburetor according to the present invention.

A state shown in FIG. 5(*c*) is a state of the high speed region where the rotational angle of the valve element 4 from the closed position (see FIG. 4) is 90 degrees, that is, the throttle valve is fully opened, and the communicated area between the second downstream body passage 11*b* and the second valve passage 21 becomes smaller than the sum of the communicated area between the first downstream body passage 10*b* and the first valve passage 20, and the communicated area between the third downstream body passage 12*b* and the third valve passage 22 (see FIG. 6). As the result, the ratio of the air relative to the mixture becomes larger, thereby enabling to sufficiently supply the scavenging air to the scavenging passage (not shown) of the two-stroke internal combustion engine (not shown). In FIG. 5(*c*), the valve element 4 is displaced against the bias of the spring 35, and the downstream body partitions 14*b*, 15*b* of the body 2 and the partitions 24, 25 of the valve element 4 are aligned with each other.

As can be seen from FIGS. 5(*a*) to 5(*c*), in the present invention, as the throttle valve is opened, the state where the communicated area between the second downstream body passage 11*b* and the second valve passage 21 is larger than the sum of the communicated area between the first downstream body passage 10*b* and the first valve passage 20 and the communicated area between the third downstream body passage 12*b* and the third valve passage 22 is changed to the reverse state where the former communicated area is smaller than the sum of the latter communicated areas.

Since the rotary carburetor according to the present invention is provided with the first and third downstream body passages (the downstream body passages for air) 10*b*, 12*b* on the opposite sides of the second downstream body passage (the downstream body passage for mixture) 11*b*, it is especially advantageous when the rotary carburetor is used with the stratified scavenging two-stroke internal combustion engine in which at least one scavenging passage is provided on each side of the mixture inlet because a piping arrangement becomes easy.

Next, referring to FIGS. 7 and 8, an operation of a rotary carburetor described in the Patent Document 1 will be explained as a comparison of the rotary carburetor according to the present invention. Prime marks "'" are added to components of the rotary carburetor described in Patent Document 1 corresponding to the components shown in FIG. 5.

Figure 7:
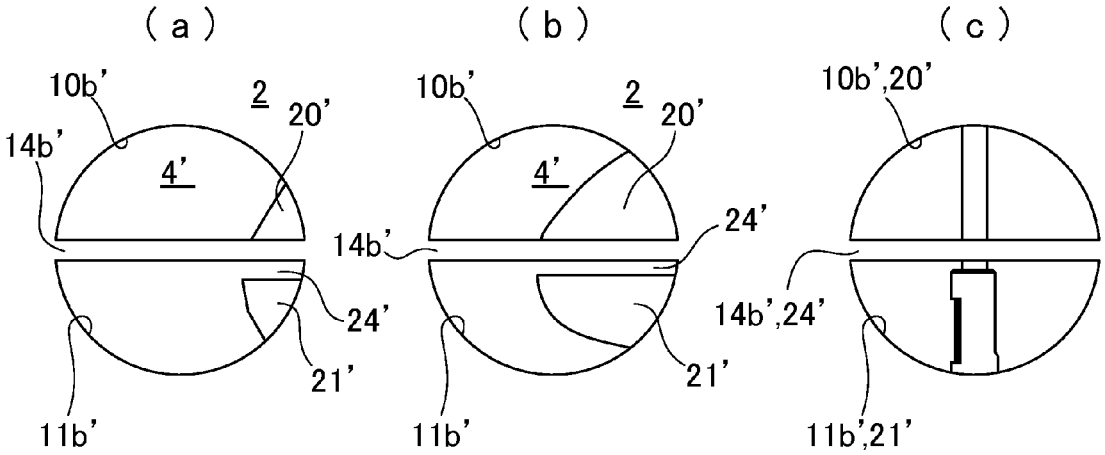
FIG. 7 is a view showing a positional relation between a downstream body passage and a valve passage in a rotary carburetor in prior art.
Figure 8:
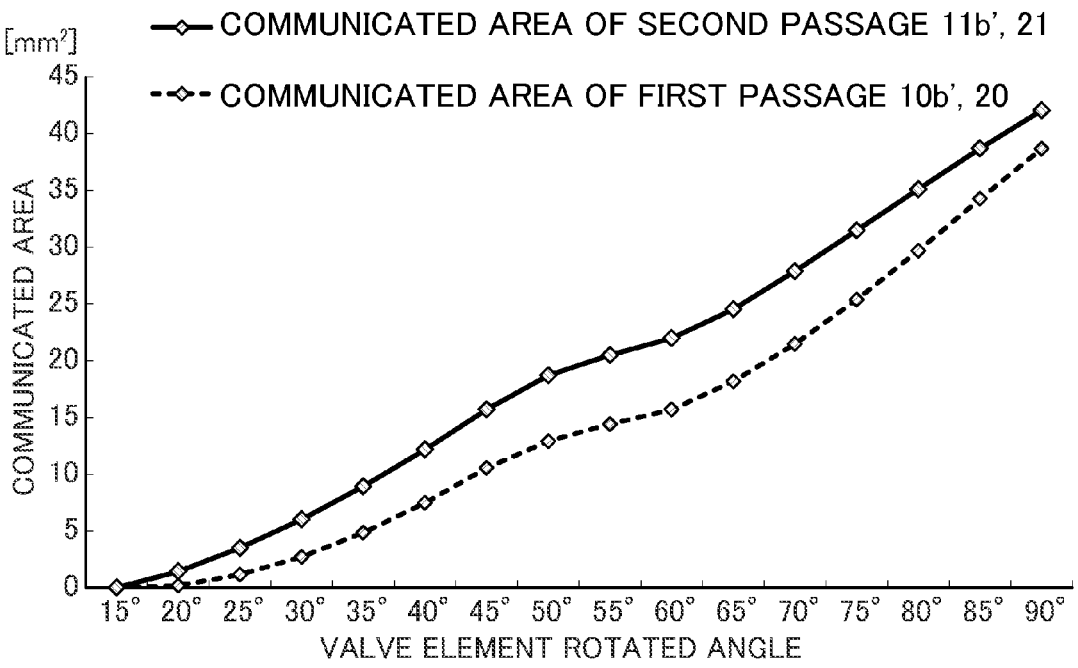
FIG. 8 is a graph showing opening areas of the mixture passage and air passage in the rotary carburetor in prior art.

A state shown in FIG. 7(*a*) is a state where the valve element 4' is rotated by the same angle as the valve element 4 shown in FIG. 5(*a*), that is, the state of the low speed region where the opening of the throttle valve is small. The communicated area between the second downstream body passage 11*b*' connected to the mixture passage (not shown) of the two-stroke internal combustion engine and the second valve passage 21' corresponding thereto is smaller than the communicated area between the first downstream body passage 10*b*' connected to the air passage (not shown) of the two-stroke internal combustion engine and the first valve passage 20' corresponding thereto. As a result, the ratio of the mixture relative to the air is not large, and the conventional acceleration performance of the two-stroke internal combustion engine is merely provided (see FIG. 8).

A state shown in FIG. 7(*c*) is a state where the valve element 4' is rotated by the same angle as the valve element 4 shown in FIG. 5(*c*), that is, the state of the high speed region where the rotational angle of the valve element 4' from the closed position (see FIG. 4) is 90 degrees, that is, the throttle valve is fully opened, and the communicated area between the second downstream body passage 11*b*' and the second valve passage 21' is smaller than the communicated area between the first downstream body passage 10*b*' and the first valve passage 20'. As a result, the ratio of the air relative to the mixture is not so large, and the conventional acceleration performance of the two-stroke internal combustion engine is merely provided (see FIG. 8).

As can be seen from FIGS. 7(*a*) to (*c*), in the Patent Document 1, while the throttle valve is being opened, the communicated area between the second downstream body passage 11*b*' and the second valve passage 21' is always smaller than the communicated area between the first downstream body passage 10*b*' and the first valve passage 20'.

Although the embodiment of the present invention has been explained above, the present invention is not limited to the above-stated embodiment, and various modifications are possible within the scope of the present invention recited in the claims, and it goes without saying that the modifications fall within the scope of the present invention.

Figure 9:
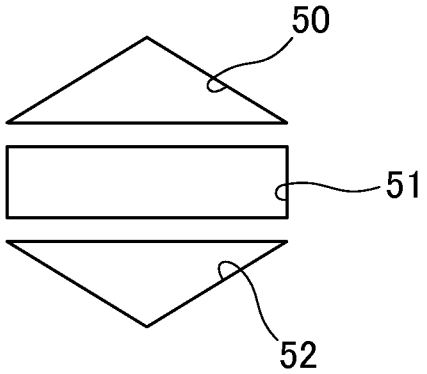
FIG. 9 is a view showing an alternative example of the downstream body passage.

In the above-stated embodiment, although the collective cross-sectional profile 42*b* of the first, second and third downstream body passages 10*b*, 11*b*, 12*b* and the collective cross-sectional profile 40 of the first, second and third valve passages 20, 21, 22 are circular, the cross-sectional profiles 40, 42*b* are arbitrary, as long as, when the valve element 4 starts to rotate from the closed position (see FIG. 4), initially, the second valve passage 21 communicates with the second downstream body passage 11*b*, and then, the first and third valve passages 20, 22 respectively communicate with the first and third downstream body passages 10*b*, 12*b*. For example, such a profile may be elliptical or, as shown in FIG. 9, the cross-sectional profiles of the first and third downstream body passages 50, 52 may be triangular, while the cross-sectional profile of the second downstream body passage 51 may be rectangular.

In the above-stated embodiment, although the upstream body passages for air 10*a*, 12*a* and the upstream body passage for mixture 11*a* are partitioned with the plate-like body partitions 14*a*, 15*a*, if there is no reverse flow of mixture from the two-stroke internal combustion engine (not shown), the upstream body partitions 14*a*, 15*a* may be omitted, that is, the upstream body passages 10*a*, 11*a*, 12*a* may be formed as a single passage without any partitions.

In the above-stated embodiment, although the cross-sectional profiles of the first, second and third upstream body passages 10*a*, 11*a*, 12*a* respectively correspond to the cross-sectional profiles of the first, second and third valve passages 20, 21, 22, these cross-sectional profiles are arbitrary so long as a sufficient amount of air is supplied to the first, second and third valve passages 20, 21, 22.

EXPLANATIONS OF REFERENCE NUMERALS

1 rotary carburetor
2 body
2*a* bore
4 valve element
10*a* first upstream body passage (upstream body passage)
10*b* first downstream body passage (downstream body passage for air)
11*a* second upstream body passage (upstream body passage)
11*b* second downstream body passage (downstream body passage for mixture)
12*a* third upstream body passage (upstream body passage)
12*b* third downstream body passage (downstream body passage for air)
14*a*, 15*a* upstream body partition
14*b*, 15*b* downstream body partition
20 first valve passage (valve passage for air)
21 second valve passage (valve passage for mixture)
22 third valve passage (valve passage for air)
24, 25 valve partition
30 nozzle unit
32 port
40 collective cross-sectional profile of valve passages
42*b* collective cross-sectional profile of downstream body passages
44, 46 apex
A axis
B direction across axis A
C direction across axis A and perpendicular to axis B

What is claimed:

1. A rotary carburetor which is used in a stratified scavenging two-stroke internal combustion engine, comprising:

a block-like body having a cylindrical bore with a center of an axis;

a valve element having a cylindrical form and rotatably contained in the bore; and a nozzle unit disposed in the valve element along the axis, wherein the valve element includes valve passages for air and a valve passage for mixture extending through the valve element in a direction across the axis, wherein the nozzle unit includes a port which is opened to the valve passage for mixture and ejects fuel, wherein the body includes upstream body passage communicating with the valve passages for air and the valve passage for mixture upstream of the valve element, and downstream body passages for air and downstream body passage for mixture respectively communicating with the valve passages for air and the valve passage for mixture downstream of the valve element, wherein the valve element is rotatable around the axis between an opened position and an closed position, wherein in the opened position, the valve passages for air and the valve passage for mixture respectively communicate with the downstream body passages for air and the downstream body passage for mixture, and the valve passages for air and the valve passage for mixture communicate with the upstream body passage, wherein in the closed position, the valve passages for air and the valve passage for mixture are respectively blocked off from the downstream body passages for air and the downstream body passage for mixture, and the valve passages for air, and the valve passage for mixture are blocked off from the upstream body passage, wherein the rotary carburetor is a one-bore type rotary carburetor in which the valve passages for air and the valve passage for mixture are partitioned with plate-like valve partitions, and the downstream body passages for air and the downstream body passage for mixture are partitioned with plate-like body partitions, wherein the two downstream body passages for air and the two valve passages for air are provided, and are respectively disposed on the opposite sides of the downstream body passage for mixture and the valve passage for mixture in the axis direction, wherein cross-sectional profiles of the downstream body passage for mixture and the valve passage for mixture are defined so that they are communicated with each other earlier than the downstream body passages for air and the valve passages for air, when the valve element is rotated from the closed position to the opened position, and wherein the cross-sectional profiles of the two downstream body passages for air and the two valve passages for air correspond to each other.

2. A rotary carburetor according to claim 1, wherein a collective cross-sectional profile of the valve passages for air and the valve passage for mixture has a profile curved in a convex form in a direction across the axis, and wherein an apex in the convex form is included in the valve passage for mixture.

3. A rotary carburetor according to claim 2, wherein the collective cross-sectional profile of the valve passages for air and the valve passage for mixture is circular.

4. A rotary carburetor according to claim 2, wherein the collective cross-sectional profile of the valve passages for air and the valve passage for mixture is elliptical.

5. A rotary carburetor according to claim 1, wherein the valve element is movable in the bore along the axis, and wherein the second valve passage and the first downstream body passage, or, the second valve passage and the third downstream body passage are partially communicated with each other during at least a portion when the valve element moves from the closed position to a fully opened position.

6. A rotary carburetor according to claim 1, wherein the upstream body passage includes upstream body passages for air and upstream body passage for mixture respectively communicating with the valve passages for air and the valve passage for mixture, and wherein the upstream body passages for air and the upstream body passage for mixture are partitioned with plate-like body partitions.

7. A rotary carburetor according to claim 5, wherein the upstream body passage includes upstream body passages for air and upstream body passage for mixture respectively communicating with the valve passages for air and the valve passage for mixture, and wherein the upstream body passages for air and the upstream body passage for mixture are partitioned with plate-like body partitions.

8. A rotary carburetor which is used in a stratified scavenging two-stroke internal combustion engine in which at least one scavenging passage is provided on each side of a mixture inlet, comprising:

a block-like body having a cylindrical bore with a center of an axis;

a valve element having a cylindrical form and rotatably contained in the bore; and a nozzle unit disposed in the valve element along the axis, wherein the valve element includes valve passages for air and valve passage for mixture extending through the valve element in a direction across the axis, wherein the nozzle unit includes a port which is opened to the valve passage for mixture and ejects fuel, wherein the body includes upstream body passage communicating with the valve passages for air and the valve passage for mixture upstream of the valve element, and downstream body passages for air and downstream body passage for mixture respectively communicating with the valve passages for air and the valve passage for mixture downstream of the valve element, wherein the valve element is rotatable around the axis between an opened position and a closed position, wherein in the opened position, the valve passages for air and the valve passage for mixture respectively communicate with the downstream body passages for air and the downstream body passage for mixture, and the valve passages for air and the valve passage for mixture communicate with the upstream body passage, wherein in the closed position, the valve passages for air and the valve passage for mixture are respectively blocked off from the downstream body passages for air and the downstream body passage for mixture, and the valve passages for air and the valve passage for mixture are blocked off from the upstream body passage, wherein the rotary carburetor is a one-bore type rotary carburetor in which the valve passages for air and the valve passage for mixture are partitioned with plate-like valve partitions, and the downstream body passages for air and the downstream body passage for mixture are partitioned with plate-like body partitions, and wherein the two downstream body passages for air and the two valve passages for air are provided and respectively disposed on each side of the downstream body passage for mixture and the valve passage for mixture in the axis direction.

* * * * *